US007472562B2

(12) United States Patent
Abe et al.

(10) Patent No.: US 7,472,562 B2
(45) Date of Patent: Jan. 6, 2009

(54) COMPRESSOR AND MECHANISM FOR SEPARATING LUBRICATING LIQUID

(75) Inventors: Yoshifumi Abe, Ritto (JP); Tatsuhisa Taguchi, Kusatsu (JP); Minoru Kajitani, Kusatsu (JP); Yukihiro Fujiwara, Kusatsu (JP); Yasuhiro Asaida, Kyoto (JP)

(73) Assignee: Panasonic Corporation, Osaka (JP)

( * ) Notice: Subject to any disclaimer, the term of this patent is extended or adjusted under 35 U.S.C. 154(b) by 597 days.

(21) Appl. No.: 10/735,723

(22) Filed: Dec. 16, 2003

(65) Prior Publication Data

US 2004/0126252 A1 Jul. 1, 2004

(30) Foreign Application Priority Data

Dec. 16, 2002 (JP) ..... 2002-363239

(51) Int. Cl.
*F25B 43/02* (2006.01)

(52) U.S. Cl. ..... 62/470; 417/313; 417/410.5

(58) Field of Classification Search ..... 417/313, 417/371, 423.1, 410.5; 62/469, 228.5, 470
See application file for complete search history.

(56) References Cited

U.S. PATENT DOCUMENTS

| | | | | |
|---|---|---|---|---|
| 4,627,861 | A * | 12/1986 | Ibaraki et al. | 96/393 |
| 5,062,773 | A * | 11/1991 | Kawai et al. | 417/269 |
| 5,219,281 | A * | 6/1993 | Caillat et al. | 418/55.6 |
| 5,494,412 | A * | 2/1996 | Shin | 417/313 |
| 6,237,362 | B1 * | 5/2001 | Jang | 62/469 |
| 6,544,009 | B2 | 4/2003 | Makino et al. | |
| 6,599,104 | B2 * | 7/2003 | Saito et al. | 417/366 |
| 6,672,101 | B2 * | 1/2004 | Gennami et al. | 62/469 |
| 2003/0002999 | A1 | 1/2003 | Sakurabayashi et al. | |
| 2003/0013343 | A1 | 1/2003 | Abe et al. | |

FOREIGN PATENT DOCUMENTS

| | | |
|---|---|---|
| JP | 4-094490 | 3/1992 |
| JP | 7-151083 | 6/1995 |
| JP | 10-196540 | 7/1998 |
| JP | 11082352 | 3/1999 |
| JP | 2000 291557 | 10/2000 |

(Continued)

OTHER PUBLICATIONS

English Language Abstract JP No. 7-151083.

(Continued)

*Primary Examiner*—Devon C Kramer
*Assistant Examiner*—Peter J Bertheaud
(74) *Attorney, Agent, or Firm*—Greenblum & Bernstein, P.L.C.

(57) ABSTRACT

A refrigerant go-around passage is provided in a housing of a compressor. The passage takes in refrigerant discharged from a compression mechanism into the housing, makes the refrigerant go around an axial line of the compressor and finally returns the refrigerant to the discharge-port side of the housing while separating liquid contained in the refrigerant from the refrigerant by centrifugation or by centrifugation and collision. In the mid portion of the refrigerant go-around passage, a liquid returning port is provided for returning the separated liquid to the housing in such a manner that the liquid returning port has an orientation that has a component in a direction of gravity and that is deviated from a traveling direction of the refrigerant.

29 Claims, 4 Drawing Sheets

FOREIGN PATENT DOCUMENTS

| | | |
|---|---|---|
| JP | 2001 020865 | 1/2001 |
| JP | 2001 280552 | 10/2001 |
| JP | 2002 070743 | 3/2002 |
| JP | 2002 115686 | 4/2002 |
| JP | 2002 174178 | 6/2002 |
| JP | 2002 180984 | 6/2002 |
| JP | 2002 188574 | 7/2002 |
| JP | 2002 285981 | 10/2002 |

OTHER PUBLICATIONS

English Language Abstract JP No. 11-082352.
English Language Abstract JP No. 2000-291557.
English Language JP No. 2001-020865.
English Language JP No. 2001-280552.
English Language JP No. 2002-070743.
English Language JP No. 2002-115686.
English Language JP No. 2002174178.
English Language JP No. 2002-180984.
English Language JP No. 2002-188574.
English Language JP No. 2002-285981.
English language Abstract of JP 10-196540.
English language Abstract of JP 4-094490.

* cited by examiner

COMPRESSOR AND MECHANISM FOR SEPARATING LUBRICATING LIQUID

The present disclosure relates to subject matter contained in priority Japanese Patent Application No. 2002-363239, filed on Dec. 16, 2002, the contents of which is herein expressly incorporated by reference in its entirety.

BACKGROUND OF THE INVENTION

1. Field of the Invention

The present invention relates to a compressor including, in a housing, a compression mechanism for sucking, compressing and discharging refrigerant and a reservoir for storing liquid for lubricating sliding portions including the compression mechanism.

2. Description of the Related Art

This type of compressor is made air-tight by connecting the housing to a refrigeration cycle. When the compression mechanism is driven, the compression mechanism sucks refrigerant in the refrigeration cycle via a suction port of the housing, and then compresses and discharges the refrigerant into the housing so as to supply the refrigerant to the refrigeration cycle via a discharge port of the housing. The above process is repeated. In conjunction with the above process, lubricating oil stored in the reservoir of the housing is supplied to the sliding portions including the compression mechanism directly or via transfer by the refrigerant, thereby lubricating the sliding portions. This allows maintenance-free operation of the compressor. The refrigerant discharged by the compression mechanism to be supplied to the refrigeration cycle contains the lubricating oil. The lubricating oil contained in the refrigerant may deteriorate the performance of the refrigeration cycle. In addition, in a case where much lubricating oil circulates in the refrigeration cycle at the same time, the lubricating oil in the sliding portions in the housing goes short. In this case, in order to make up for this short of lubricating oil, it is necessary to increase the capacity of the reservoir and the amount of lubricating oil that can be supplied, thus increasing the size and weight of the compressor.

In order to overcome the above problem, techniques have been conventionally known in which the lubricating oil in the refrigerant discharged from the compression mechanism is separated from the refrigerant by centrifugation before the refrigerant is supplied to the refrigeration cycle and the separated lubricating oil is returned to the reservoir in the housing. See Japanese Patent Laid-Open Publication Nos. Hei 07-151083 and Hei 11-082352, for example. According to this technique, the refrigerant discharged from the compression mechanism and the lubricating oil are separated from each other by centrifugation in accordance with a so called cyclone system. More specifically, the refrigerant discharged from the compression mechanism is tangentially introduced into an upper portion of a cylindrical centrifugal chamber that is arranged perpendicularly to the axial line of the compressor, so as to form a spiral downward flow in the introduced refrigerant, which travels downward along the cylindrical surface of the centrifugal chamber, thereby separating the lubricating oil from the refrigerant. The refrigerant thus separated is then made to flow from the lower portion of the centrifugal chamber, pass through the central portion thereof, and go out of the centrifugal chamber upward to enter the refrigeration cycle. The lubricating oil thus separated is caused to blast out from the lower portion of the centrifugal chamber into the housing of the compressor so as to be returned to the reservoir.

According to the method disclosed in Japanese Patent Laid-Open Publication No. Hei 11-082352, the lubricating oil after separation by centrifugation is blasted out in a parallel direction to a surface of the lubricating oil stored in the reservoir so as not to fluctuate the lubricating oil surface. In this manner, the level of the lubricating oil stored in the reservoir is kept constant and the supply of lubricating oil to the sliding portions is stabilized. Also, a back-flow of the lubricating oil in the reservoir to the centrifugal chamber caused by the fluctuation of the lubricating oil surface can be prevented.

In recent years, a sealed type compressor mentioned above has been installed in a vehicle for air-conditioning of a vehicle compartment. The vehicle is required to reduce its weight because of growing interest in environmental and energy problems. Especially, the weight reduction in the vehicle is the most significant issue since in an electric vehicle or hybrid vehicle the same level of driving force as that of a gasoline-powered vehicle cannot be obtained. Thus, it is significant to reduce the size and weight of the compressor that is relatively heavy, in particular, an electric compressor that further includes an electric motor in a case where the compressor is mounted on a vehicle.

However, the aforementioned cyclone type separation mechanism for separating lubricating oil, that is used in the above conventional compressor, necessitates a larger space that ensures formation of both a flow of refrigerant that is being separated by centrifugation, which goes downward in the centrifugal chamber while being pressed against the cylindrical surface of the centrifugal chamber to leave lubricating oil on the cylindrical surface and another flow of refrigerant after separation that goes from the lower portion of the centrifugal chamber, passes through the central portion and then goes out of the centrifugal chamber upward to be discharged from the centrifugal chamber. The separation mechanism becomes relatively large in a diameter even if a cylindrical wall for separating those flows from each other is provided. Thus, the size of the space occupied by the separation mechanism in the housing of the compressor becomes larger in the direction of the axial line of the compressor, preventing the size and weight reduction.

SUMMARY OF THE INVENTION

An object of the present invention is to provide a compressor which separates lubricating oil from refrigerant in a relatively small space so that the size and weight of the compressor are reduced.

In order to achieve the above object, according to a first aspect of the invention, a compressor includes: a compression mechanism for sucking, compressing and discharging refrigerant; a reservoir for storing liquid for lubricating sliding portions including the compression mechanism; and a housing for containing the compression mechanism and the reservoir. The compressor further includes a refrigerant go-around passage, provided in the housing, for introducing the refrigerant discharged from the compression mechanism into the housing via a refrigerant introducing port, making the refrigerant go around an axial line of the compressor and returning the refrigerant to a discharge-port side of the housing via a refrigerant returning port, while separating the liquid from the refrigerant by centrifugation or by centrifugation and collision, wherein a liquid returning port is provided for returning the separated liquid into the housing in a wall of a mid part of the refrigerant go-around passage in such a manner that the liquid returning port has an orientation that has a component in a direction of gravity and that is deviated from a traveling direction of the refrigerant.

In this structure, the refrigerant go-around passage introduces the refrigerant that was discharged from the compression mechanism and is traveling toward the discharge port of the housing therein via the refrigerant introducing port and makes the refrigerant go around the axial line of the compressor. Then, the refrigerant go-around passage returns the refrigerant toward the discharge port of the housing via the refrigerant returning port. During the go-around of the refrigerant, the liquid contained in the refrigerant that flows in the passage is separated from the refrigerant by centrifugation or by centrifugation and collision, so as to be left on a centrifugal side or gravity-side wall of the refrigerant go-around passage. The refrigerant after separation of the liquid continues to flow in the refrigerant go-around passage, and is then returned into the housing via the refrigerant returning port finally. The separated liquid is returned into the housing via the liquid returning port provided in the mid part of the refrigerant go-around passage without entering of the refrigerant via the liquid returning port, because the liquid returning port has the orientation that is deviated from the traveling direction of the refrigerant and that contains the component in the direction of gravity. Thus, the refrigerant go-around passage separates the refrigerant and the liquid from each other only by making the refrigerant discharged from the compression mechanism flow in one direction. It is not necessary to form the refrigerant go-around passage to have a large area, unlike a cyclone type. Since the refrigerant go-around passage has a long length inside the housing, the ability of separating the liquid is increased in proportion to the length of the passage. Accordingly, the refrigerant go-around passage is formed to extend in the circumferential direction with a greatly reduced size in the direction along the axial line of the compressor, thereby further reducing the size and weight of the compressor.

According to another aspect of the invention, a horizontal type compressor to be placed at an angle or horizontally, includes: a compression mechanism for sucking, compressing and discharging refrigerant; a reservoir for storing liquid for lubricating sliding portions including the compression mechanism; and a housing for containing the compression mechanism and the reservoir. The compressor further includes a refrigerant go-around passage for introducing the refrigerant discharged from the compression mechanism into the housing via a refrigerant introducing port provided in an upper portion of the housing, making the refrigerant go around an axial line of the compressor and returning the refrigerant to a discharge-port side of the housing via a refrigerant returning port provided in the upper portion of the housing, while separating the liquid from the refrigerant by centrifugation or by centrifugation and collision, wherein a liquid returning port is provided for returning the separated liquid into the housing in a wall of a mid part in a lower part of the refrigerant go-around passage in such a manner that the liquid returning port has an orientation that has a component in a direction of gravity and that is deviated from a traveling direction of the refrigerant.

In the above structure, the refrigerant go-around passage is arranged to surround the axial line of the compressor, which is at an angle or horizontal. The refrigerant go-around passage introduces the refrigerant that was discharged from the compression mechanism and is traveling toward the discharge port of the housing into the refrigerant go-around passage via the refrigerant introducing port that is provided in the upper portion of the housing to be away from the liquid stored in the housing without being affected by the stored liquid. Then, the refrigerant go-around passage makes the refrigerant go around the axial line so as to return the refrigerant toward the discharge port of the housing via the refrigerant returning port that is provided in the upper portion of the housing to be away from the stored liquid without affecting the stored liquid. In this case, the refrigerant go-around passage separates the liquid contained in the traveling refrigerant by centrifugation or by centrifugation and collision in accordance with the configuration of the passage to leave the liquid on the centrifugal side or gravity-side wall. The refrigerant after separation of the liquid continues to travel in the refrigerant go-around passage so as to be returned into the housing via the refrigerant returning port, while the liquid after separation is returned into the liquid stored in the housing or a portion near the stored liquid via the liquid returning port. The liquid returning port is provided in the wall of the mid part of the refrigerant go-around passage that is, in the lower portion of the passage, because the separated liquid gathers together at a lower position in the refrigerant go-around passage. Since the liquid returning port has the orientation that is deviated from the traveling direction of the refrigerant and that contains the component in the direction of gravity, the gathering liquid is softly returned into the housing without blow out of the refrigerant. In this way, the refrigerant go-around passage separates the refrigerant and the liquid from each other only by making the refrigerant discharged from the compression mechanism flow in one direction. It is not necessary to form the refrigerant go-around passage to have a large area, unlike a cyclone type. Since the refrigerant go-around passage has a long length inside the housing, the ability of separating the liquid is increased in proportion to the length of the passage. Accordingly, the refrigerant go-around passage is formed to extend in the circumferential direction with a greatly reduced size in the direction along the axial line of the compressor, thereby further reducing the size and weight of the compressor.

Other objects and features of the invention will become more apparent in the following detailed description of embodiments and accompanying drawings. Each feature of the invention can be adopted either alone or in various possible combinations.

BRIEF DESCRIPTION OF THE DRAWINGS

FIGS. 2A-2C show a substrate having a concave streak formed therein for forming a refrigerant go-around passage of the separation mechanism shown in FIG. 1, wherein FIG. 2A is a front view, and FIGS. 2B and 2C are cross-sectional views, seen from different sides of the substrate, respectively;

FIGS. 3A and 3B show a lid for forming together with the substrate shown in FIGS. 2A-2C the refrigerant go-around passage, wherein FIG. 3A is a front view and FIG. 3B is cross-sectional view.

DETAILED DESCRIPTION OF THE PREFERRED EMBODIMENTS

Figure 1:
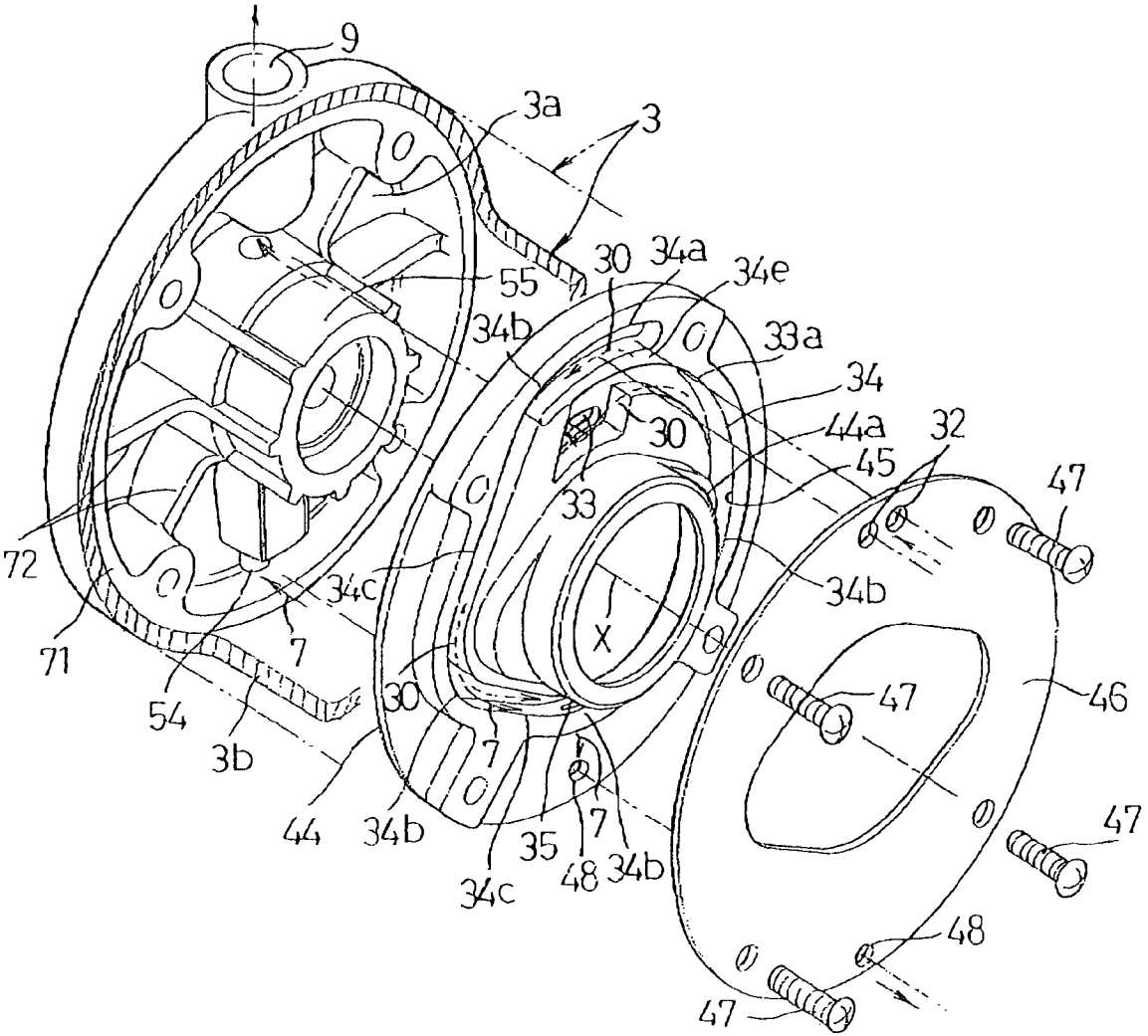
FIG. 1 is an exploded perspective view of a separation mechanism for separating refrigerant and lubricating oil from each other in a compressor according to an embodiment of the present invention.

A compressor according to an embodiment of the present invention will be described in detail, referring to FIGS. 1-4.

The compressor of this embodiment is a horizontal-type scroll compressor 1 for refrigeration cycle that is to be placed horizontally in such a manner that mounting legs 2 arranged around the body of the compressor 1 support the body. The compressor 1 includes a compression mechanism 4, an electric motor 5 for driving the compression mechanism 4, and a housing 3 for containing the mechanism 4 and the motor 5. The compressor 1 also includes a reservoir 6 in the housing 3, for storing liquid for lubricating sliding portions including the compression mechanism 4. Refrigerant used in the compressor 1 is gas refrigerant. However, in a case where liquid refrigerant is used, that refrigerant and the liquid to be separated from the refrigerant can be handled equally and can be separated from each other. As the liquid for lubricating the sliding portions and sealing a sliding portion of the compression mechanism 4, liquid such as lubricating oil 7 is used. This liquid is compatible with respect to the refrigerant. However, the invention is not limited to the above. The invention can be applied to any type of compressor, as long as it includes a compression mechanism for sucking, compressing and discharging refrigerant and a reservoir for storing liquid for lubricating sliding portions including the compression mechanism, the mechanism and the reservoir being contained in a housing.

The compression mechanism 4 of this embodiment includes a compression space 10 formed by a fixed scroll member 11 and an orbiting scroll member 12 that engage with each other. The fixed scroll member 11 and the orbiting scroll member 12 include blades rising from a fixed mirror plate 11*a* and a rotating mirror plate 12*a*, respectively. When the orbiting scroll member 12 is caused to move on a circular orbit with respect to the fixed scroll member 11 by the electric motor 5 via a drive shaft 14, the compression space 10 changes its volume with the circular movement. In this manner, the compression mechanism 4 sucks refrigerant 30 from an outside cycle via a suction port 8 as shown with an arrow of broken line in FIG. 4, compresses the refrigerant 30 and discharges the refrigerant 30 to the outside cycle via a discharge port 9 of the housing 3.

In addition, lubricating oil 7 stored in the reservoir 6 is supplied to a liquid pool 21 and/or a liquid pool 22 on the back of the orbiting scroll member 12 via the drive shaft 14 with the rotation of the orbiting scroll member 12 by driving a displacement type pump 13 with the drive shaft 14, employing a differential pressure in the housing 3 or the like. In the shown example, the lubricating oil 7 is supplied to the liquid pool 21. The thus supplied lubricating oil 7 is then supplied to the back side of the outer peripheral portion of the orbiting scroll member 12 through the scroll member 12 while being regulated to a predetermined amount by a diaphragm 23 or the like, so as to back up the orbiting scroll member 12. The lubricating oil 7 is also supplied to a holding groove 25 for holding a chip seal 24 as an exemplary sealing member between top end of the blade of the orbiting scroll member 12 and the fixed scroll member 11 through the scroll member 12; thereby sealing the fixed and orbiting scroll members 11 and 12 and lubricating them.

The compressor 1 is provided with a refrigerant go-around passage 34 for making the refrigerant 30 discharged from the discharge port 31 of the compression mechanism 4 go around the axial line X of the compressor 1. This refrigerant go-around passage 34 introduces the refrigerant 30 via a refrigerant introduction port 32 as shown with arrows of broken line in FIGS. 1 and 4 and then makes the introduced refrigerant 30 go around the axial line X of the compressor 1 as shown with arrows of broken line in FIGS. 1 and 2A, thereby returning the refrigerant 30 toward the discharge port 9 of the housing 3 via the refrigerant returning port 33 while separating the lubricating oil 7 contained in the refrigerant 30 from the refrigerant 30 by centrifugation or by centrifugation and collision as shown with arrows of solid line in FIGS. 1 and 2A. Furthermore, the refrigerant go-around passage 34 is provided with a liquid returning port 35 for returning the separated lubricating oil 7 into the housing 3. The liquid returning port 35 is provided in a wall of the mid part of the refrigerant go-around passage 34 so as to have an orientation that has the component in the direction of gravity and that is deviated from the traveling direction of the refrigerant.

As shown in FIGS. 1 and 2A-2C, the refrigerant go-around passage 34 has the axial line X that is common to the compression mechanism 4 and the electric motor 5, and has larger curved portions 34*a* at both ends, having relatively large radius of curvature. The larger curved portions 34*a* are arranged to be close to the inside of the housing 3 and are approximately concentric. Between the larger curved portions 34*a*, smaller curved portions 34*b* having a smaller radius of curvature than that of the larger curved portion 34*a* and approximately straight portions 34*c* are formed to be connected alternately. The refrigerant go-around passage 34 makes the refrigerant 30 go around so as to separate the lubricating oil 7 from the refrigerant 30 by centrifugation. Moreover, at the time when the refrigerant 30 enters the smaller curved portion 34*b* from the larger curved portion 34*a* and the time when it enters the smaller curved portion 34*b* from the straight portion 34*c*, the refrigerant 30 hits a passage wall 34*d* in accordance with the degree of sharpness in changing of the traveling direction of the refrigerant 30, thereby separating the lubricating oil 7 from the refrigerant 30 by collision.

Such separation by collision enhances its separation effect as the traveling direction of the refrigerant 30 changes sharper. Thus, in order to enhance the separation effect, a bend section or a collision wall can be provided in the mid portion of the refrigerant go around passage 34. In an example shown with imaginary line in FIG. 2A, a collision wall 36 is provided in the downstream of the liquid returning port 35 in the refrigerant go-around passage 34 so that the refrigerant 30 that is passing by the liquid returning port 35 toward to be returned into the housing 3 is made to collide against the collision wall 36, thereby separating the lubricating oil 7. Thus, in a case where such a collision wall 36 is provided in the downstream closely adjacent to the liquid returning port 35 as shown with broken line in FIG. 2A, the separation of the lubricating oil 7 is accelerated by causing collision of the refrigerant 30 that is passing by the liquid returning port 35 against the collision wall 36. In addition, the lubricating oil 7 that has been separated from the refrigerant 30 is blocked by that time from moving toward the downward side, thereby increasing a rate of recovery into the housing 3 via the liquid returning port 35. In a case where a member for separating the lubricating oil 7 is provided in the downstream of the collision wall 36, it is necessary to provide an escape path that does not prevent the lubricating oil 7 separated by that member from going back to the liquid returning port 35 or provide another liquid returning port in the downstream of the collision wall 36 so as to allow the separated lubricating oil 7 to go back into the housing 3. Furthermore, the above-described collision wall 36 forms a diaphragm-like portion where the refrigerant go-around passage 34 becomes narrower, together with the wall of the passage 34 that is opposed to the collision wall 36. Thereby, the refrigerant and lubricating oil are separated from each other by such a diaphragm-like portion. Please note that the diaphragm-like portion can be provided irrespective of the presence or absence of the collision wall 36 and, in order to prevent the collision wall 36 and the opposed wall of the passage 34 from forming such a diaphragm-like portion, the opposed wall can be cut to form an escape portion.

The refrigerant go-around passage 34 takes in the refrigerant 30 that was discharged into the housing 3 from the compression mechanism 4 and then flows toward the discharge port 9, via the refrigerant introducing port 32. The thus taken refrigerant 30 is made to go around the axial line X of the compressor 1 as shown with arrows of broken line in FIGS. 1 and 2A. Then, the refrigerant 30 is returned back toward the discharge port 9 via the refrigerant returning port 33. During the go-around of the refrigerant 30, the refrigerant go-around passage 34 separates the lubricating oil 7 by centrifugation or by centrifugation and collision, while leaving the separated lubricating oil 7 on the gravity-side or centrifugal side wall of the passage 34. The refrigerant 30 from which the lubricating oil 7 was separated is made to flow to be returned into the housing 3, via the refrigerant returning port 33. On the other hand, the separated lubricating oil 7 left on the wall is also returned back into the housing 3 via the liquid returning port 35 provided in the wall of the mid part of the passage 34 without the refrigerant 30 entering the housing 3 through the liquid returning port 35, because the returning port 35 has an orientation that is out of the traveling direction of the refrigerant 30 and that has the component in the direction of gravity. The recovery of the lubricating oil 7 to the housing 3 via the liquid returning port 35 is done more smoothly and with higher recovery rate, as an angle of the liquid returning port 35 with respect to the traveling direction of the refrigerant 30 is acuter and as the orientation of the returning port 35 is closer to the direction of gravity.

As described above, the refrigerant go-around passage 34 separates the refrigerant 30 and the lubricating oil 7 from each other only by making the refrigerant 30 discharged from the compression mechanism 4 go around in one direction. Thus, this passage 34 does not necessitate a large space, unlike a cyclone type separation mechanism. Moreover, the refrigerant go-around passage 34 has a long length that is close to the inner circumferential length of the housing 3 and thus has separation ability in proportion to the length of the passage 34. The size of the refrigerant go-around passage 34 in the direction along the axial line X of the compressor 1 is greatly reduced without lowering the separation ability. This is advantageous to the reduction of the size and weight of the compressor 1. In the example shown in FIG. 4, the refrigerant go-around passage 34 has a size in the direction along the axial line X that corresponds to about 1/24 of the length of the compressor 1 in the same direction.

Figure 2B:
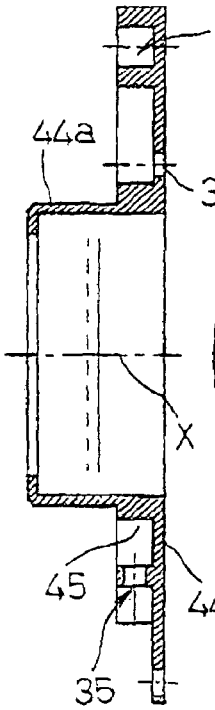
Figure 2A:
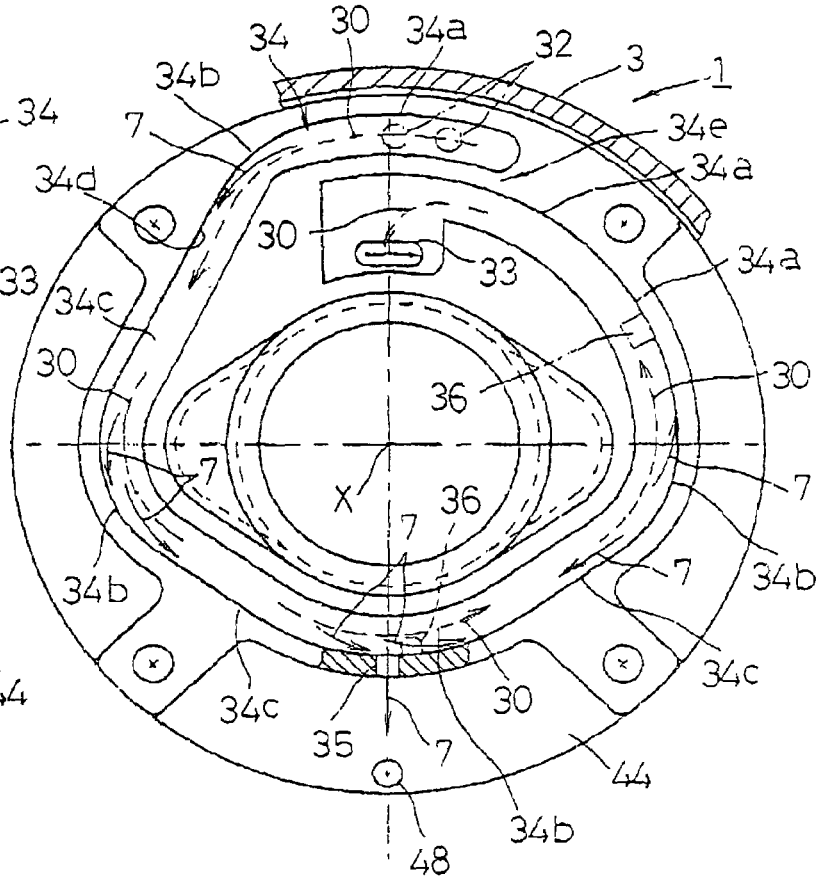
Figure 2C:
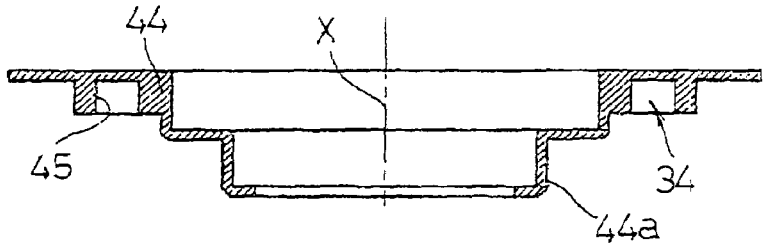
Figure 3A:
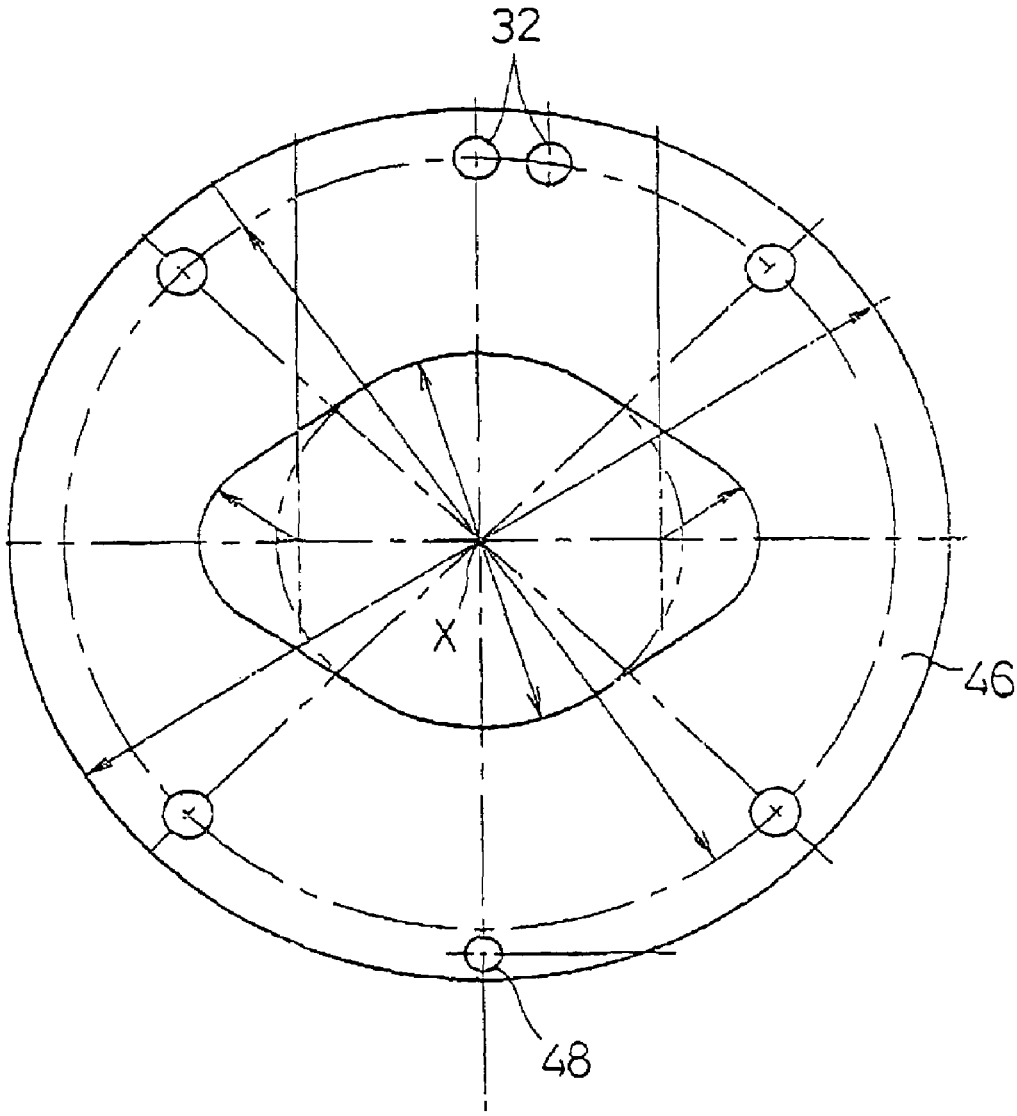
Figure 3B:
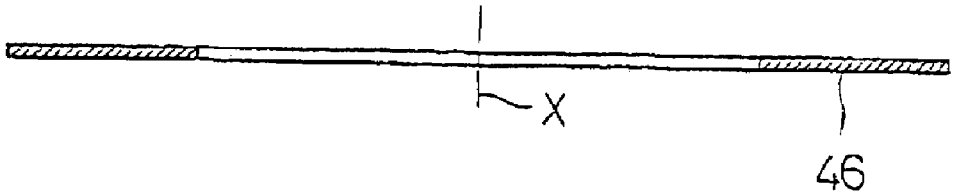
Figure 4:
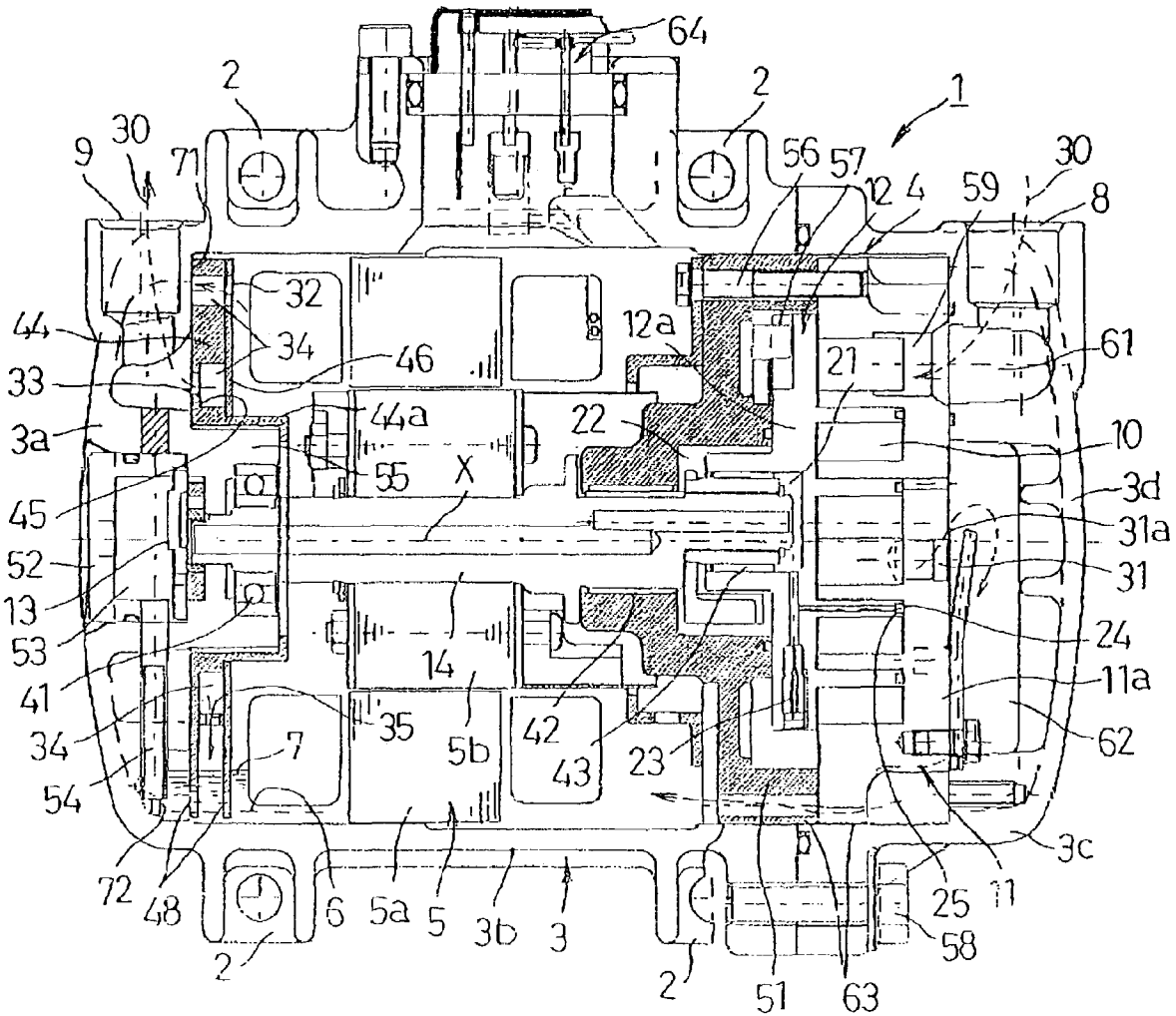
FIG. 4 is a cross-sectional view of the entire compressor including the separation mechanism shown in FIG. 1.

Considering that the compressor 1 is a horizontal type, in order to handle a case where the axial line X is at an angle, the refrigerant go-around passage 34 is arranged in the following manner. The refrigerant go-around passage 34 takes in the refrigerant 30 discharged from the compression mechanism 4 via the refrigerant introducing port 32 provided in the upper portion of the housing 3, as shown in FIGS. 1, 2A and 4; then makes go around the axial line X of the compressor 1, as shown with arrows of broken line in FIGS. 1 and 2A, while separating the lubricating oil 7 by centrifugation or by centrifugation and collision, so as it finally return the refrigerant toward the discharge port 9 via the refrigerant returning port 33 provided in the upper portion of the housing 3. In the wall of the mid portion of the refrigerant go-around, passage 34, that is on the lower side of the passage 34, the liquid returning port 35 is provided for returning the separated lubricating oil 7 into the housing 3 in such a manner that the returning port 35 has an orientation that is deviated from the traveling direction of the refrigerant and that has the component in the direction of gravity. In the shown example, the liquid returning port 35 is provided along the direction of gravity.

The refrigerant go-around passage 34 is arranged to surround the axial line X of the compressor 1 that is at an angle or horizontal, as shown in FIGS. 1, 2A and 4. The passage 34 takes in the refrigerant 30 that flows toward the discharge port 9 after being discharged from the compression mechanism 4 via the refrigerant introducing port 32. Because the introducing port 32 is provided in the upper portion of the housing 3 to be away from lubricating oil 7 stored in the housing 3, the introduction of refrigerant 30 is not affected by the stored lubricating oil 7. Then, the passage 34 causes the taken refrigerant 30 to flow around the axial line X and finally returns it toward the discharge port 9 via the refrigerant returning port 33. The return of refrigerant 30 has no effect on the lubricating oil 7 stored in the housing 3 because the returning port 33 is provided in the upper portion of the housing 3 to be away from the stored lubricating oil 7.

While the refrigerant 30 flows in the refrigerant go-around passage 34, the passage 34 separates the lubricating oil 7 contained in the flowing refrigerant 30 by centrifugation or by centrifugation and collision to leave the separated lubricating oil 7 on the centrifugal side or gravity-side wall. Then, the refrigerant 30 from which the lubricating oil 7 was separated continues to flow in the passage 34 and then reaches the refrigerant returning port 33. On the other hand, the separated lubricating oil 7 gathers, downward along the passage wall, as shown with an arrow of solid line in FIG. 2A. Thereby, the lubricating oil 7 is returned softly via the liquid returning port 35 provided in the lower part of the refrigerant go-around passage 34 into the lubricating oil 7 stored in the housing 3 or a portion near that stored lubricating oil 7 without entering of the refrigerant 30, because the liquid returning port 35 has the orientation that is deviated from the traveling direction of the refrigerant 30 and that has the component in the direction of gravity.

The refrigerant go-around passage 34 can be extended by being formed to be spiral. However, in this embodiment, the entire passage 34 is arranged on the same plane. Thus, the space occupied by the passage 34 in the direction along the axial line X of the compressor 1 is minimum, contributing to the reduction of the size and weight of the compressor 1. Moreover, by providing an overlapping portion 34*e* where a portion of the refrigerant go-around passage 34 overlaps another portion of the passage 34 to form a volute, as shown in FIGS. 1 and 2A, the passage 34 can be extended without increasing its size in the direction along the axial line X thus improving the ability of separating the lubricating oil 7.

The refrigerant go-around passage 34 can be provided anywhere between a position at which the refrigerant 30 is discharged from the compression mechanism 4 and the discharge port 9. In this embodiment, the passage 34 is provided at the discharge-port side end in the housing 3. Thus, the refrigerant go-around passage 34 is provided so as not to interfere with the compression mechanism 4 and the electric motor 5. Moreover, because the passage 34 is positioned at the discharge-port side end, there is an advantage that the lubricating oil 7 is separated and discharged to the outside of the housing 3 after being used for cooling the electric motor 5 with the refrigerant 30 or lubricating the sliding portions other than the compression mechanism 4, such as a sub-shaft bearing 41. The discharged lubricating oil 7 is then supplied to the outside cycle. Please note that a main shaft bearing 42, an eccentric-shaft bearing 43 and the like which are arranged on the compression-mechanism side are lubricated by the lubricating oil 7 supplied to the compression mechanism 4, via the liquid pools 21 and 22.

The refrigerant go-around passage 34 can be formed by any method. For example, it can be formed by bending an existing tube. However, in a case where the refrigerant go-around passage 34 is formed by a concave streak 45, that is formed on an end wall 3*a* or on a substrate 44 attached to the housing 3 as shown in FIGS. 1 and 2A, and a lid 46 for covering that concave streak 45 as shown in FIG. 1, the passage 34 can be formed in any shape precisely because the concave streak 45 can be formed by casting or engraving. Especially, in a case where the concave streak 45 is formed on the end wall 3*a* of the housing 3, a member for forming the concave streak 45 is eliminated. In a case where the concave streak 45 formed on the substrate 44 is covered by the lid 46 as in the present embodiment, time and effort for attachment is reduced by attaching the substrate 44 to the housing 3 together with the lid 46. In any of the above cases, the lid 46 is convenient because it can be used as a partition for dividing the inside of the housing into the discharge-port side and the other side in order to introduce the refrigerant 30 discharged from the compression mechanism 4 into the passage 34 via the refrigerant introducing port 32, as in the present embodiment. The lowermost portions of the substrate 44 and the lid 46 has a distributing hole 48 for distributing the lubricating oil 7, that was separated and returned into the housing 3, in the reservoir 6. However, that distributing hole 48 cannot affect the partitioning function because it is submerged in the lubricating oil 7 in the reservoir 6. Please note that the substrate 44 and the lid 46 can be attached anywhere in the housing 3. Also, the substrate 44 and the lid 46 can be attached to the housing 3 separately from each other.

In the present embodiment, as shown in FIG. 1, the substrate 44 is put on an annular step 71 formed near the end wall 3*a* and in the inner circumference of the housing 3 so as to be screwed together with the lid 46 by using screws 47. Inside the end wall 3*a*, a rib 72 that is slightly lower than the step 71 is provided around a housing 55 in a radial pattern. That rib 72 reinforces the end wall 3*a* and the housing 55, and also regulates the movement of the lubricating oil 7 when the lubricating oil 7 in the reservoir 6 is sucked between the end wall 3*a* and the substrate 44 by a pump 13 via a suction passage 54, thereby preventing the excess suction and consumption of the lubricating oil 7.

A plurality of refrigerant introducing ports 32 can be provided at a plurality of positions that are distributed in the circumferential direction of the refrigerant go-around passage 34 and/or along the axial line X of the compressor 1. The other ports, i.e., the refrigerant returning ports 33 and the liquid returning ports 35 can be provided similarly. However, the effect of the present invention is achieved by providing each of the refrigerant introducing port 32, refrigerant returning port 33 and liquid returning port 35 at one position in the circumferential direction. In this embodiment, two refrigerant introducing ports 32 are provided along the circumferential direction. More refrigerant 30 can be introduced into the refrigerant go-around passage 34 while preventing the blow back of the refrigerant 30 that may occur in a case where a single large refrigerant introducing port is provided, thereby increasing the traveling speed of the introduced refrigerant 30. This enhances the effect of separation of the lubricating oil 7 by centrifugation or by centrifugation and collision.

When a guide for collecting the refrigerant and guiding the refrigerant toward the refrigerant introducing port 32, that has a funnel-like shape for example, is provided at the refrigerant introducing port 32 instead of the above or in addition to the above the introduced amount of the refrigerant 30 increases and thus the traveling speed of the refrigerant 30 in the refrigerant go-around passage 34 also increases. Thus, the effect of separating the lubricating oil is enhanced.

The compressor 1 of the present embodiment will be described in more detail. In a main case 3*b* having the end wall 3*a* the pump 13, the sub-shaft bearing 41, the electric motor 5 and a main shaft bearing member 51 including the main shaft bearing 42 and the eccentric-shaft bearing 43 are arranged in that order from the end-wall side. The pump 13 is placed in the main case 3*b* from the outer-side of the end wall 3*a* to be held between the end wall 3*a* and a lid 52. Inside the lid 52, a pump room 53 is formed such that the pump room 53 communicates with the reservoir 6 via the suction passage 54. The sub-shaft bearing 41 is supported by the housing 55 to support one side of the drive shaft 14, the side being connected to the pump 13. The housing 55 is formed integrally with a portion of the end wall 3*a* that corresponds to an inner side of the portion where the pump 13 is housed. The electric, motor 5 has a rotor 5*a* fixed to the inner circumference of the main case 3*b* by shrink fitting or the like and a rotor 5*b* fixed around the mid portion of the drive shaft 14. The electric motor 5 rotates the drive shaft 14 by these rotors 5*a* and 5*b*. The main shaft bearing member 51 is fixed to the inner circumference of the main case 3*b* by shrink fitting or the like. On the outer surface of the main shaft bearing member 51, the fixed scroll member 11 is bolted with a bolt 56 and the like. By providing the orbiting scroll member 12 between the main shaft bearing member 51 and the fixed scroll member 11, the compression mechanism 4 is constituted. Further, an autorotation regulating member 57 for preventing autorotation of the orbiting scroll member 12, such as an Oldham ring is restrained between the main shaft bearing 51 and the orbiting scroll member 12. The drive shaft 14 is connected to the orbiting scroll member 12 via the eccentric shaft bearing 43 so as to allow the orbiting scroll member 12, to rotate on a circular orbit.

An exposed portion of the compression mechanism 4 that is not covered by the main case 3*b* is covered by a sub-case 3*c* that is bolted to the main case 3*b* with a bolt 58 or the like. Between an end wall 3*d* of the sub-case 3*c* and the back of the fixed scroll member 11, a suction chamber or passage 61 and a discharge chamber or passage 62 are formed. The suction chamber 61 connects the suction port 8 to a suction port 59 of the compression mechanism 4, while the discharge chamber 62 makes the refrigerant 30 be discharged from the discharge port 31 of the compression mechanism 4 via a reed valve 31*a* toward the electric motor 5.

The discharge chamber 62 communicates with the electric-motor side through a passage 63 formed between the fixed scroll member 11 and the main shaft bearing member 51 or between them and the housing 3. The substrate 44 of the refrigerant go-around passage 34 has a cover part 44*a* that covers the housing 55 so that the substrate 44 is faced toward the outer circumference of the housing 55. The refrigerant go-around passage 34 is formed by using a donut-like planar space between the body of the housing 3 and the substrate 44, the space having an orientation perpendicular to the axial, line X. In the mid portion of the body of the housing 3, a feeding terminal 64 for feeding a power to the electric motor is provided. This prevents the increase in the size of the compressor 1 in the direction along the axial line X.

According to a compressor of the invention, while a refrigerant go-around passage takes in refrigerant that was discharged from a compression mechanism and then flows toward a discharge port of the housing, via a refrigerant introducing port; causes the refrigerant to go around an axial line of the compressor; and finally returns the refrigerant toward the discharge port via a refrigerant returning port, the passage separates the refrigerant and liquid contained in the refrigerant from each other by centrifugation or by centrifugation and collision only by causing the discharged refrigerant to flow in one direction. Moreover the refrigerant go-around passage has a longer length along the inner circumference of the housing and separation ability thereof is improved in proportion to the length of the passage. Thereby, the refrigerant go-around passage has a reduced size in the direction along the axial line of the compressor, thus contributing to the reduction of the size and weight of the compressor without lowering the separation ability.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A compressor, comprising:

a compression mechanism that draws, compresses and discharges refrigerant;

a reservoir configured to store liquid which lubricates the compression mechanism;

a housing that contains the compression mechanism and the reservoir; and a refrigerant go-around passage which introduces the refrigerant discharged from the compression mechanism into the housing via a refrigerant introducing port, the refrigerant go-around passage being spaced from and surrounding a structure which surrounds an axial line of the compressor, the refrigerant go-around passage comprising larger curved portions, smaller curved portions, and approximately straight portions, the larger curved portions having a radius of curvature which is larger than a radius of curvature of the smaller curved portions, the curvature of the large curved portions are concentric with the axial line of the compressor, the smaller curved portions and the approximately straight portions are alternatingly connected to each other along a path defined by the refrigerant go-around passage, both the smaller curved portions and the approximately straight portions provided between the large curved portions along the path defined by the refrigerant go-around passage, the refrigerant being directed around the axial line of the compressor and returned to a discharge-port side of the housing via a refrigerant returning port, while separating the liquid from the refrigerant by centrifugation or by centrifugation and collision, wherein a liquid returning port is provided to return the separated liquid into the housing in a wall of a mid part of the refrigerant go-around passage in such a manner that the liquid returning port has an orientation that has a component in a direction of gravity and that is deviated from a traveling direction of the refrigerant.

2. The compressor of claim 1, wherein the refrigerant introducing port is provided in an upper portion of the housing;

wherein the refrigerant returning port is provided in the upper portion of the housing; and wherein the wall of the mid part is provided in a lower part of the refrigerant go-around passage.

3. The compressor according to claim 1, wherein the refrigerant go-around passage is arranged on a same plane.

4. The compressor according to claim 1, wherein the refrigerant go-around passage is provided at a discharge-port side end of the housing.

5. The compressor according to claim 1, wherein the refrigerant go-around passage comprises a concave streak and a lid which covers the concave streak, the concave streak being formed on a substrate attached to the housing or to an end wall of the housing.

6. The compressor according to claim 5, wherein the substrate is attached to the housing together with the lid.

7. The compressor according to claim 1, wherein each of the refrigerant introducing port, the refrigerant returning port, and the liquid returning port is provided at at least one position in the traveling direction of the refrigerant.

8. The compressor according to claim 1, wherein the refrigerant introducing port is provided with a guide which directs the collected refrigerant into the refrigerant introducing port.

9. The compressor according to claim 1, further comprising:

an electric motor that is housed in the housing and that drives the compression mechanism.

10. The compressor according to claim 2, wherein the refrigerant go-around passage is arranged on a plane.

11. The compressor according to claim 2, wherein the refrigerant go-around passage is provided at a discharge-port side end of the housing.

12. The compressor according to claim 2, the refrigerant go-around passage comprising a concave streak and a lid which covers the concave streak, the concave streak being formed on a substrate attached to the housing or to an end wall of the housing.

13. The compressor according to claim 12, wherein the substrate is attached to the housing together with the lid.

14. The compressor according to claim 2, wherein each of the refrigerant introducing port, the refrigerant returning port, and the liquid returning port is provided at at least one position in the traveling direction of the refrigerant.

15. The compressor according to claim 2, wherein the refrigerant introducing port is provided with a guide which directs the collected refrigerant into the refrigerant introducing port.

16. The compressor according to claim 2, further comprising:

an electric motor that drives the compression mechanism and that is housed in the housing.

17. The compressor according to claim 1, wherein the refrigerant go-around passage is provided in the housing.

18. The compressor according to claim 1, wherein a cross-sectional area of the refrigerant go-around passage, excluding the return port, is substantially uniform.

19. A compressor, comprising:

a compression mechanism which draws, compresses and discharges refrigerant;

a reservoir configured to store liquid which lubricates the compression mechanism;

a housing that contains the compression mechanism and the reservoir; and a refrigerant go-around passage comprising a spiraling channel, the spiraling channel of the refrigerant go-around passage comprising larger curved portions, smaller curved portions and approximately straight portions, the larger curved portions having a radius of curvature which is larger than a radius of curvature of smaller curved portions, the curvature of the large curved portions are concentric with the axial line of the compressor, the smaller curved portions and the approximately straight portions alternatingly connected to each other along a path defined by the spiraling channel, both the smaller curved portions and the approximately straight portions provided between the large curved portions along the path defined by the spiraling channel, wherein the refrigerant go-around passage introduces the refrigerant discharged from the compression mechanism into the housing via a refrigerant introducing port, wherein the refrigerant is directed around an axial line of the compressor and returned to a discharge-port side of the housing via a refrigerant returning port, while separating the liquid from the refrigerant by centrifugation or by centrifugation and collision, wherein a liquid returning port returns the separated liquid into the housing in a wall of a mid part of the refrigerant go-around passage in such a manner that the liquid returning port has an orientation that has a component in a direction of gravity and that is deviated from a traveling direction of the refrigerant.

20. The compressor according to claim 1, wherein the refrigerant go-around passage further comprises a bending section provided in a mid-portion of the path defined by the refrigerant go-around passage.

21. The compressor according to claim 1, wherein the refrigerant go-around passage further comprises a collision wall provided in a mid-portion of the path defined by the refrigerant go-around passage, wherein collision between the collision wall and the refrigerant separates the liquid from the refrigerant.

22. The compressor according to claim 1, wherein the refrigerant go-around passage further comprises a collision wall provided at a down-stream side of the refrigerant go-around passage which is adjacent to the liquid returning port, wherein collision between the collision wall and the refrigerant separates the liquid from the refrigerant.

23. The compressor according to claim 22, wherein the refrigerant go-around passage further comprises a liquid escape path provided at the down-stream side of the refrigerant go-around passage, the liquid escape path configured to allow the liquid separated from the refrigerant to return to the liquid returning port.

24. The compressor according to claim 1, wherein the separated liquid is returned to the reservoir which stores liquid that lubricates the compression mechanism.

25. The compressor according to claim 19, wherein the spiraling channel further comprises a bending section provided in a mid-portion of the path defined by the spiraling channel.

26. The compressor according to claim 19, wherein the refrigerant go-around passage further comprises a collision wall provided in a mid portion of the path defined by the spiraling channel, wherein collision between the collision wall and the refrigerant separates the liquid from the refrigerant.

27. The compressor according to claim 19, wherein the refrigerant go-around passage further comprises a collision wall provided at a down-stream side of the refrigerant go-around passage which is adjacent to the liquid returning port, wherein collision between the collision wall and the refrigerant separates the liquid from the refrigerant.

28. The compressor according to claim 27, wherein the refrigerant go-around passage further comprises a liquid escape path provided at the down-stream side of the refrigerant go-around passage, the liquid escape path configured to allow the liquid separated from the refrigerant to return to the liquid returning port.

29. The compressor according to claim 19, wherein the separated liquid is returned to the reservoir which stores liquid that lubricates the compression mechanism.

* * * * *